US005348850A

United States Patent [19]

Yoshida

[11] Patent Number: 5,348,850

[45] Date of Patent: Sep. 20, 1994

[54] SILVER HALIDE PHOTOGRAPHIC MATERIAL AND METHOD OF PROCESSING THE SAME

[75] Inventor: Tetsuo Yoshida, Kanagawa, Japan

[73] Assignee: Fuji Photo Film Co., Ltd., Kanagawa, Japan

[21] Appl. No.: 112,342

[22] Filed: Aug. 27, 1993

[30] Foreign Application Priority Data

Aug. 27, 1992 [JP] Japan ..... 4-228745

[51] Int. Cl.[5] ..... G03C 1/12; G03C 1/09

[52] U.S. Cl. ..... 430/575; 430/427; 430/573; 430/577; 430/578; 430/579; 430/600; 430/601; 430/603; 430/610; 430/608; 430/963

[58] Field of Search ..... 430/575, 579, 573, 578, 430/577, 585, 600, 603, 608, 601, 610, 963, 427

[56] References Cited

U.S. PATENT DOCUMENTS

| | | | |
|---|---|---|---|
| 4,857,450 | 8/1989 | Burrows et al. | 430/604 |
| 5,112,731 | 5/1992 | Miyasaka | 430/567 |
| 5,215,880 | 6/1993 | Kojima et al. | 430/603 |
| 5,238,807 | 8/1993 | Sasaki et al. | 430/600 |

FOREIGN PATENT DOCUMENTS 359637 3/1991 Japan .

*Primary Examiner*—Thorl Chea
*Attorney, Agent, or Firm*—Sughrue, Mion, Zinn, Macpeak & Seas

[57] ABSTRACT

A silver halide photographic material has on a support at least one light-sensitive silver halide emulsion layer which comprises silver halide emulsion grains having a chloride content: of at least 50 mol % and containing a metal selected from rhodium, ruthenium and rhenium in an amount of at least $10^{-8}$ mole per mole of silver, said silver halide emulsion being spectrally sensitized with a compound of general formula (I) and being chemically sensitized with a selenium or tellurium compound:

(I)

wherein Z and $Z_1$ each represents a group of nonmetallic atoms necessary to complete a 5- or 6-membered nitrogen-containing heterocyclic nucleus; R and $R_1$ each represents an unsubstituted or substituted alkyl group, or an unsubstituted aryl group; Q and $Q_1$ each represents a group of atoms necessary to complete a 4-thiazolidinone, 5-thiazolidinone or 4-imidazolidinone nucleus; L, $L_1$ and $L_2$ each represents an unsubstituted or substituted methine group; $n_1$ and $n_2$ each represents 0 or 1; X represents an anion; and m represents 0 or 1, wherein m=0 indicates that the dye forms an inner salt. The photographic material provides high sensitivity to He—Ne laser light and ensures high contrast in the photographic images.

16 Claims, No Drawings

SILVER HALIDE PHOTOGRAPHIC MATERIAL AND METHOD OF PROCESSING THE SAME

FIELD OF THE INVENTION

The present invention relates to a silver halide photographic material, more particularly to a photosensitive material which ensures high sensitivity and high contrast upon short exposure using an He—Ne laser as a light source, which enables reduction in replenishment rates of processing solutions, and which has excellent suitability for rapid processing. The present invention further relates to a method of processing said material.

BACKGROUND OF THE INVENTION

A scanner system has recently prevailed in the graphic arts. Various kinds of light sources have been used in practice in recording apparatuses of the type which adopt a scanner system at the formation of images. In particular, a He—Ne laser has come into wide use because it is stable and can provide a high image quality. The exposure time in the scanning exposure is very short, and ranges from $10^{-3}$ to $10^{-7}$ second. Therefore, it is required that photosensitive materials for scanning exposure use have high sensitivity and provide high contrast images even upon such short exposure as described above.

Further, workers in the graphic arts are strongly desirous that operations be increased in speed and efficiency, that is, that the scanning operation be speeded up and the processing time of photosensitive materials be shortened. With respect to the developer and the fixer used in the processing operation, it is desirable that the amounts of developer and fixer to be used be reduced from the viewpoints of storage and recovery cost of the wastes or environmental pollution problems, so that expectations for reduction in the replenishment rates of the developer and the fixer are on the rise.

As a photosensitive material suitable for exposure with an He—Ne light source and for rapid processing, JP-A-3-59637 (the term "JP-A" as used herein means an "unexamined published Japanese patent application") discloses a photosensitive material in which carbocyanine or rhodacyanine dyes are used as spectral sensitizers and the gelatin contents of the emulsion layers and protective layers are specified. In addition, the above reference discloses in its examples silver chlorobromide emulsions which contain iridium and rhodium and which are sensitized with gold and sulfur compounds. However, the photosensitive material cited above is low in sensitivity and is not wholly satisfactory with respect to the consistency in photographic properties achieved by continuous photographic processing performed under a reduced replenishment condition, though it is satisfactory from the viewpoints of gradation and color stain.

SUMMARY OF THE INVENTION

Therefore, an object of the present invention is to provide a silver halide photographic material which has high sensitivity to a He—Ne laser as a light source and which ensures high contrast in the photographic images.

Another object of the present invention is to provide a photosensitive material having consistent photographic properties even when the replenishment rates of processing solutions are reduced, and to provide a method of processing said material.

A further object of the present invention is to provide a photosensitive material which enables rapid photographic processing, and to provide a method of processing said material.

The term "rapid photographic processing" as used herein refers to a processing in which it takes the top of a photosensitive material 15 to 60 seconds to travel from the insertion slit of an automatic developing machine to the exit of the drying part of the machine via the developing tank, the transit part, the fixing tank, the transit part, the washing tank and the drying part in succession.

The above-described objects of the present invention have been attained with a silver halide photographic material which has on a support at least one layer of a light-sensitive silver halide emulsion comprising silver halide grains having a chloride content of at least 50 mole % and containing a metal selected from rhodium, ruthenium and rhenium in an amount of at least $10^{-8}$ mole per mole of silver, said silver halide emulsion being spectrally sensitized with a compound having a structure represented by the following general formula (I) and being chemically sensitized with a selenium or tellurium compound; and with a method of processing said material:

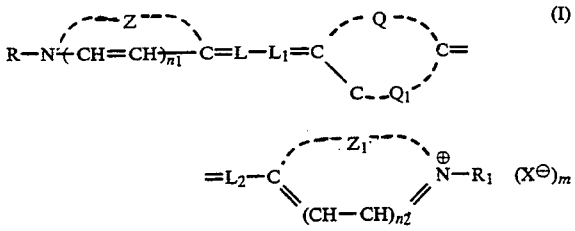

(I)

wherein Z and $Z_1$ each represents a group of nonmetallic atoms necessary to complete a 5- or 6-membered nitrogen-containing heterocyclic nucleus; R and $R_1$ each represents an unsubstituted or substituted alkyl group, or an unsubstituted aryl group; Q and $Q_1$ each represents a group of atoms necessary to complete a 4-thiazolidinone, 5-thiazolidinone or 4-imidazolidinone nucleus; L, $L_1$ and $L_2$ each represents an unsubstituted or substituted methine group; $n_1$ and $n_2$ each represents 0 or 1; X represents an anion; and m represents 0 or 1, wherein m=0 indicates that the dye forms an inner salt.

DETAILED DESCRIPTION OF THE INVENTION

The silver halide emulsion used in the present invention comprises silver chlorobromide or iodochlorobromide grains having a chloride content of at least 50 mole %, preferably at least 70 mole %.

The silver halide grains used in the present invention are preferably fine grains (e.g., those having an average grain size of no greater than 0.7 μm), especially those having an average grain size of no greater than 0.5 μm.

The silver halide grains used in the present invention may have any crystal shape, such as that of a cube, an octahedron, a tetradecahedron, a plate or a sphere. Also, they may be a mixture of grains having different crystal shapes. However, it is desirable for them to be cubic, tetradecahedral or tabular grains.

As for the grain size distribution, it is desirable that the emulsion be monodisperse.

The term "monodisperse emulsion" as used herein refers to a silver halide emulsion having a grain size distribution represented by a variation coefficient of 20% at most, preferably 15% at most. The term "variation coefficient (%)" is defined as the value obtained by dividing the standard deviation of the silver halide grain size distribution by the average grain size and then multiplying said quotient by 100.

Photographic emulsions used in the present invention can be prepared using methods as described, e.g., in P. Glafkides, *Chemie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964), and so on.

Specifically, any process, including an acid process, a neutral process and an ammoniacal process, may be employed. Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed. On the other hand, the so-called controlled double jet method, in which the pAg of the liquid phase wherein silver halide grains are to be precipitated is maintained constant, may be employed.

According to this method, a silver halide emulsion having a regular crystal shape and an almost uniform distribution of grain sizes can be obtained.

For the purpose of rendering the grain sizes uniform, it is also desirable that the grain growth be accelerated within the limits of the critical saturation degree by using a method of changing the addition speed of silver nitrate or an alkali halide depending on the speed of grain growth, as disclosed in British Patent 1,535,016, JP-B-48-36890 (the term "JP-B" as used herein means an "examined Japanese patent publication") and JP-B-52-16364, or a method of changing the concentrations of the aqueous solutions, as disclosed in U.S. Pat. No. 4,242,445 and JP-A-55-158124.

The silver halide grains may differ in halide composition between the inner part and the surface layer, that is, the grains may have a so-called core/shell type structure.

With respect to the metals rhodium, ruthenium and rhenium to be used in the present invention, these metals can be used in the form of known compounds. In particular, water soluble complex salts thereof are used to advantage. The properties of these metals change greatly depending on the ligands which constitute the complex salts together with said metals, as disclosed in JP-A-2-20852 and JP-A-2-20853. These metals are used in the present invention with the intention of increasing the contrast. As for the ligands, on the other hand, it is desirable that they include halogen atoms, water molecules and nitrosyl or thionitrosyl groups as disclosed in JP-A-2-20852. In this case, the nature of the counter ion is not critical, so that conventional counter ions such as an ammonium ion or an alkali metal ion can be used as the counter ion. Specific examples of the metal complexes which can be used in the present invention are given below.

| | | |
|---|---|---|
| $[RhCl_6]^{-3}$ | $[RhCl_5(H_2O)]^{-2}$ | $[RhBr_6]^{-3}$ |
| $[RhCl_5(NS)]^{-2}$ | $[RhCl_5(NO)]^{-2}$ | $[Rh(CN)_5(H_2O)]^{-2}$ |

-continued

| | | |
|---|---|---|
| $[RhF_6]^{-3}$ | $[Rh(NO)Cl(CN)_4]^{-2}$ | |
| $[ReCl_6]^{-3}$ | $[Re(NO)(CN)_5]^{-2}$ | $[Re(NO)Cl_5]^{-2}$ |
| $[ReBr_6]^{-3}$ | $[ReCl_5(NS)]^{-2}$ | $[Re(CN)_5(H_2O)]^{-2}$ |
| $[RuCl_6]^{-3}$ | $[Ru(NO)(CN)_5]^{-2}$ | $[Ru(NO)Cl_5]^{-2}$ |
| $[RuBr_6]^{-3}$ | $[RuCl_5(NS)]^{-2}$ | $[Ru(CN)_5(H_2O)]^{-2}$ |

In using these metal compounds, they are dissolved in water or an appropriate solvent. To stabilize such solutions, any conventional method can be used, such as a method of adding an aqueous solution of a hydrogen halide (e.g., hydrogen chloride, hydrogen bromide, hydrogen iodide) or an alkali halide (e.g., KCl, NaCl, KBr, NaBr).

Instead of using the water-soluble salts cited above, foreign silver halide grains previously doped by these metals can be added to a system for preparing the silver halide grains and dissolved therein.

The total amount of the metal compounds added in the present invention ranges properly from $5\times10^{-9}$ to $1\times10^{-4}$ mole, preferably from $1\times10^{-8}$ to $1\times10^{-6}$ mole, and particularly preferably from $5\times10^{-8}$ to $5\times10^{-7}$ mole, per mole of the finally prepared silver halide.

Although they can be added properly in any stage during the preparation or before the coating of the silver halide emulsion, it is particularly desirable that the metal compounds be added in the stage of grain formation so as to be incorporated in the silver halide grains. Further, compounds containing the Group VIII elements may be used in addition to the above-described metal compounds. In particular, the combined use of two or three kinds of metal compounds, which are chosen from the present metal compounds and iridium or/and iron salts, is of advantage.

As for the selenium sensitizers, known compounds can be used in the present invention. In general, chemical sensitization can be effected by adding a selenium compound of the unstable type and/or a selenium compound of the stable type to the silver halide emulsion and stirring the resulting emulsion at a high temperature of at least 40° C. for a definite time. Suitable examples of selenium compounds of the unstable type include those disclosed in JP-B-44-15748, JP-B-43-13489, JP-A-4-109240 and JP-A-4-324855, and so on. In particular, the compounds represented by the general formulae (VIII) and (IX) in JP-A-4-324855 are used to greater advantage. Specific examples of such compounds are illustrated below:

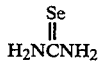
S-1

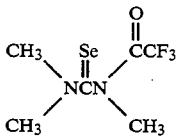
S-2

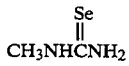
S-3

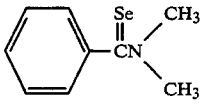
S-4

-continued

S-5 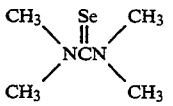

S-6 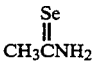

S-7 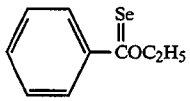

S-8 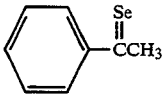

S-9 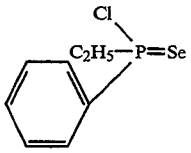

S-10 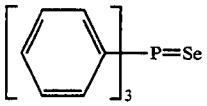

S-11 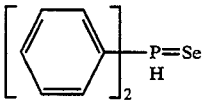

S-12 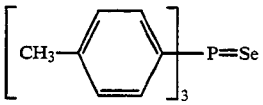

S-13 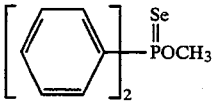

S-14 $(nC_4H_9)_3P{=}Se$

S-15 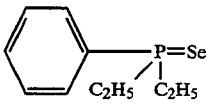

S-16 $(C_2H_5O)_3P{=}Se$

S-17 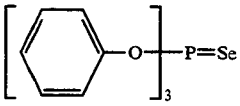

S-18 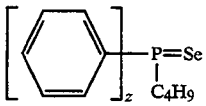

-continued

S-19 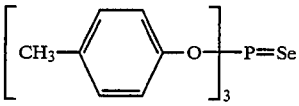

S-20 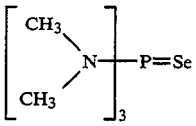

Tellurium sensitizers which can be used in the present invention are compounds capable of producing silver telluride, which is presumed to function as a sensitizing nucleus, on the surface or inside of silver halide grains. The production rate of silver telluride in a silver halide emulsion can be determined by the method disclosed in Japanese Patent Application No. 4-146739.

Examples of such tellurium compounds include those disclosed in U.S. Pat. Nos. 1,623,449, 3,320,069 and 3,772,031, British Patents 235,211, 1,121,496, 1,295,462 and 1,396,696, Canadian Patent 800,958 and JP-A-4-204640, JP-A-4-271341, JP-A-4-333043 and Japanese Patent Application No. 4-129787; and the compounds described, e.g., in *J. Chem. Soc. Chem. Commun.*, 635 (1980); ibid., 1102 (1979); ibid., 645 (1979); *J. Chem. Soc. Perkin Trans.*, 1, 2191 (1980); S. Patai (editor), The *Chemistry of Organic Selenium and Tellurium Compounds*, vol. 1 (1986) and vol. 2 (1987). In particular, the compounds represented by the general formulae (II), (III) and (IV) in Japanese Patent Application No. 4-146739 are used to great advantage. Specific examples of such compounds are illustrated below:

T-1 $(nC_4H_9)_3P{=}Te$

T-2 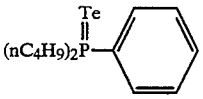

T-3 $(iC_3H_7)_2P(Te)C_4H_9(n)$

T-4 $C_2H_5P(Te)(OC_2H_5)_2$

T-5 $(nC_4H_9O)_3P{=}Te$

T-6 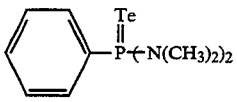

T-7 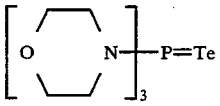

T-8 $(C_2H_5)_2P(Te)N(C_2H_5)_2$

T-9 $(C_2H_5)_2P(Te)N(C_2H_5)_2$

-continued

T-10

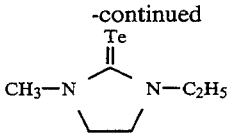

T-11

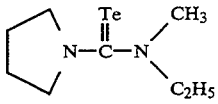

T-12

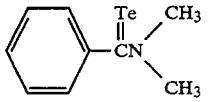

T-13

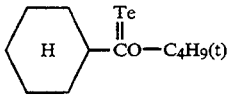

T-14

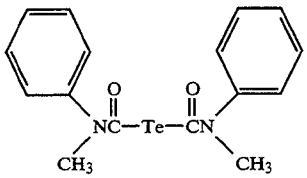

T-15

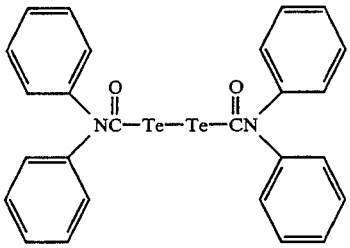

T-16

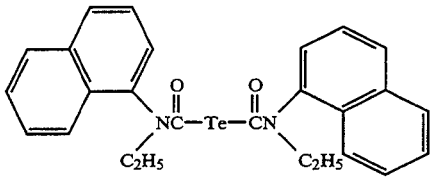

The respective amounts of selenium and tellurium sensitizers used in the present invention, though they depend on the conditions under which the silver halide grains are ripened chemically, are generally within the range of $10^{-8}$ to $10^{-2}$ mole, preferably on the order of from $10^{-7}$ to $10^{-3}$ mole, per mole of silver halide, respectively.

Although the present invention does not impose any particular restriction on chemical sensitization, the chemical sensitization is generally carried out under conditions such that the pH is adjusted to 5 to 8, the pAg to 6 to 11, preferably 7 to 10, and the temperature to 40° to 95° C., preferably 45° to 85° C.

It is desirable in the present invention that the above-described sensitizers be used together with precious metal sensitizers, such as gold, platinum, palladium, iridium and like metal compounds. In particular, the combined use with gold sensitizers is preferred. Suitable examples of such gold sensitizers include chloroauric acid, potassium aurichlorate, potassium aurithiocyanate, auric sulfide and so on. These gold sensitizers can be used in an amount of about $10^{-7}$ to about $10^{-2}$ mole per mole of silver halide.

Also, it is desirable for the above-described sensitizers to be further combined with sulfur sensitizers. As specific examples of sulfur sensitizers which can be used, there can be given known unstable sulfur compounds, such as thiosulfates (e.g., hypo), thioureas (e.g., diphenyl thiourea, triethyl thiourea, allyl thiourea), rhodanines and so on. Such sulfur sensitizers can be used in an amount of about $10^{-7}$ to about $10^{-2}$ per mole of silver halide.

Now, the above-illustrated formula (I) representing the sensitizing dyes used in the present invention will be described below in detail.

Specific examples of the nitrogen-containing heterocyclic nucleus completed by Z or $Z_1$ include thiazole nuclei (e.g., thiazole, 4-methylthiazole, 4-phenylthiazole, 4,5-dimethylthiazole, 4,5-diphenylthiazole), benzothiazole nuclei (e.g., benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-methoxybenzothiazole, 5-ethoxybenzethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5,6-dimethoxybenzothiazole, tetrahydrobenzothiazole), naphtothiazole nuclei (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nuclei (e.g., 4-methylselenazole, 4-phenylselenazole), benzoselenazole nuclei (e.g., benzoselenazole, 5-chlorobenzoselenazole, 5-phenylbenzoselenazole, 5-methoxybenzoselenazole, 5-methylbenzoselenazole, 5-hydroxybenzoselenazole), naphthoselenazoles (e.g., naphtho[2,1-d]selenazole, naphtho[1,2-d]selenazole), oxazoles (e.g., oxazole, 4-methyloxazole, 5-methyloxazole, 4,5-dimethyloxazole), benzoxazole nuclei (e.g., benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole, 5-hydroxybenzoxazole), naphthoxazole nuclei (e.g., naphtho[2,1-d]oxazole, naphtho[1,2-d]oxazole, naphtho[2,3-d]oxazole), 2-quinoline nuclei, imidazole nuclei, benzimidazole nuclei, 3,3'-dialkylindolenine nuclei, 2-pyridine nuclei, thiazoline nuclei, and so on. In particular, the cases in which at least either Z or $Z_1$ completes a thiazole, benzothiazole, thiazoline, oxazole or benzoxazole nucleus are preferred.

As for the alkyl group represented by R or $R_1$ in the above formula (I), alkyl groups containing less than 5 carbon atoms (e.g., methyl, ethyl, n-propyl, n-butyl) are examples thereof. As for the substituted alkyl group represented by R or $R_1$, substituted alkyl groups whose alkyl moiety contains less than 5 carbon atoms are examples thereof. Specific examples of such substituted alkyl groups include hydroxyalkyl groups (e.g., 2-hydroxyethyl, 3-hydroxypropyl, 4-hydroxybutyl), carboxyalkyl groups (e.g., carboxymethyl, 2-carboxyethyl, 3-carboxypropyl, 4-carboxybutyl, 2-(2-carboxyethoxy)ethyl), sulfoalkyl groups (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3'-sulfopropoxy)propyl, 2-[2'-(3-sulfopropoxy)ethoxy]ethyl, 2-hydroxy-3-(3'-sulfopropoxy)propyl), aralkyl groups (preferably those which contain from 1 to 5 carbon atoms in their respective alkyl moieties and a phenyl group as their respective aryl moieties, with specific examples including benzyl, phenethyl, phenylpropyl, phenylbutyl, p-tolylpropyl, p-methoxyphenethyl, p-chlorophenethyl, p-carboxybenzyl, p-sulfophenethyl, p-sulfobenzyl and the like), aryloxyalkyl groups (preferably those which contain from 1 to 5 carbon atoms in their respective alkyl moieties and a phenyl group as the aryl group of their respective aryloxy moieties, with specific examples including phenoxyethyl, phenoxypropyl, phenoxybutyl, p-methylphenoxyethyl, p-methoxyphenoxypropyl and so on), vinylmethyl group, and so on. As for the aryl group, a phenyl group is an example thereof. L, $L_1$ and $L_2$ each represents an unsubstituted methine group or a substituted methine group of the formula =C(R')—. Herein, R' represents an alkyl group (e.g., methyl, ethyl), a substituted alkyl group [e.g., an alkoxyalkyl group (e.g., 2-ethoxyethyl), a carboxyalkyl group ( e.g., 2-carboxyethyl), an alkoxycarbonylalkyl group (e.g., 2-methoxycarbonylethyl), an aralkyl group (e.g., benzyl, phenethyl), an aryl group (e.g., phenyl, p-methoxyphenyl, p-chlorophenyl, o-carboxyphenyl], and so on. Further, L and $L_1$ may combine with R and $R_1$ respectively via a methine chain to complete a nitrogen-containing heterocyclic ring. Examples of a substituent group attached to the nitrogen atom present at the 3-position of a thiazoline or imidazoline nucleus completed by Q and $Q_1$ include alkyl groups (preferably those containing 1 to 8 carbon atoms, e.g., methyl, ethyl, propyl), an allyl group, aralkyl groups (preferably those containing 1–5 carbon atoms in their respective alkyl moieties, e.g., benzyl, p-carboxyphenylmethyl), aryl groups (in which the number of carbon atoms is preferably from 6 to 9 in total, e.g., phenyl, p-carboxyphenyl), hydroxyalkyl groups (preferably those containing 1 to 5 carbon atoms in their respective alkyl moieties, e.g., 2-hydroxyethyl), carboxyalkyl groups (preferably those containing 1 to 5 carbon atoms in their respective alkyl moieties, e.g., carboxymethyl), alkoxycarbonylalkyl groups (in which it is preferable for the alkyl radical of the alkoxy moiety to contain 1 to 3 carbon atoms and for the alkyl moiety to contain 1 to 5 carbon atoms, e.g., methoxycarbonylethyl), and so on.

Examples of the anion represented by X include halide ions (e.g., iodide ion, bromide ion, chloride ion), perchlorate ion, thiocyanate ion, benzenesulfonate ion, p-toluenesulfonate ion, methylsulfate ion, ethylsulfate ion and so on.

Specific examples of compounds of general formula (I) are illustrated below:

I-1

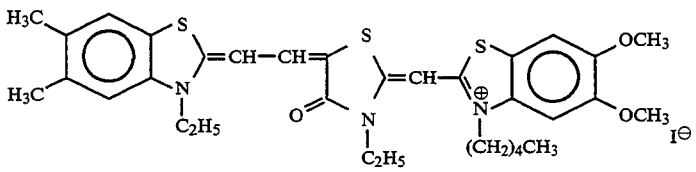

I-2

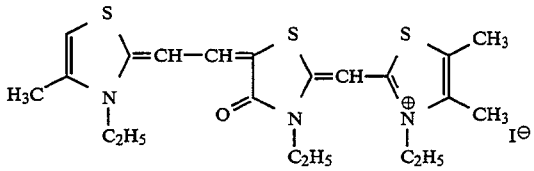

I-3

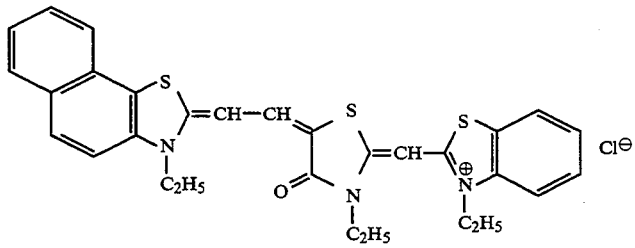

I-4

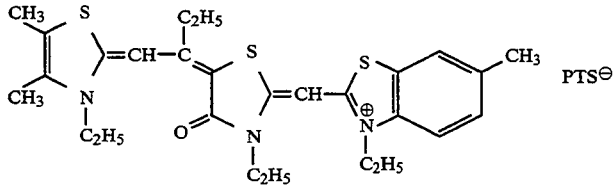

-continued
I-5
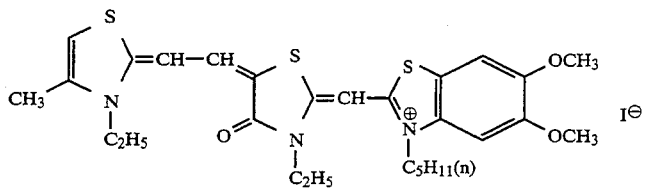
I-6
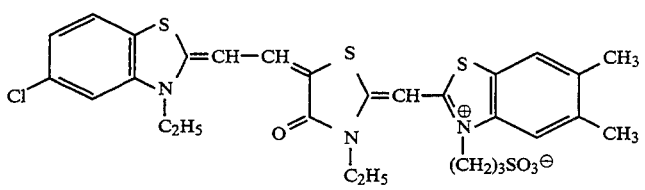
I-7
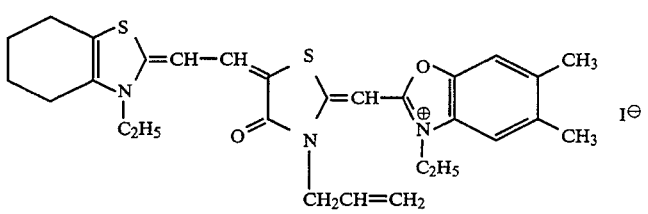
I-8
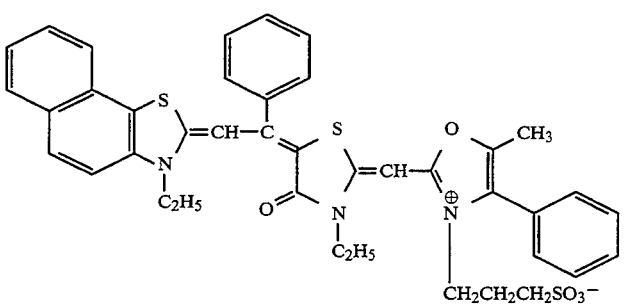
I-9
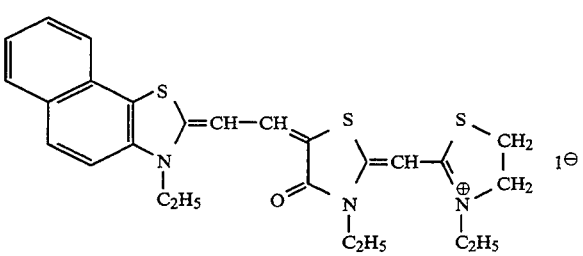
I-10
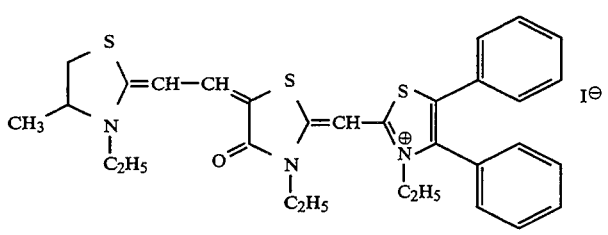
I-11
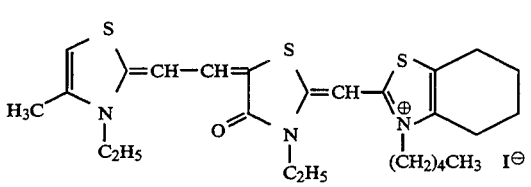

-continued
I-12
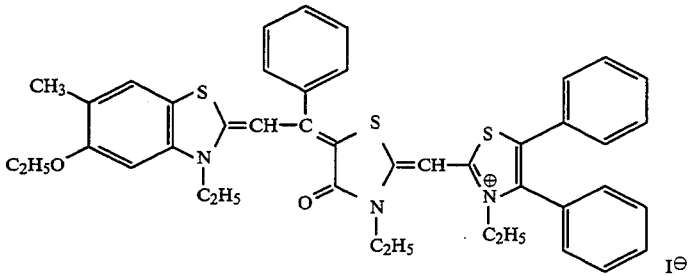
I-13
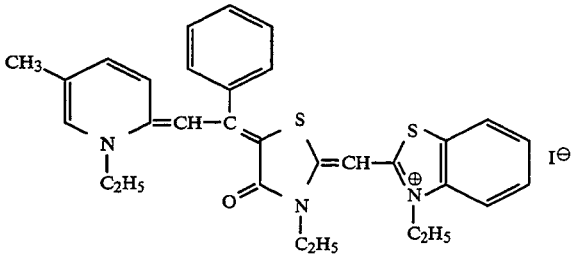
I-14
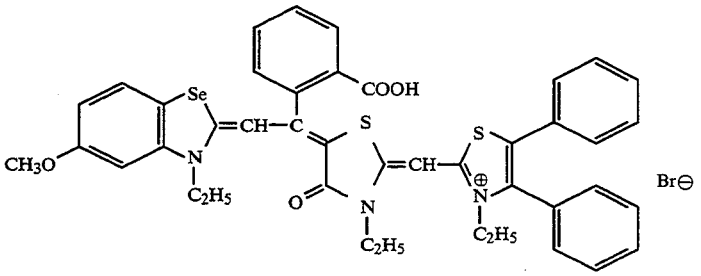
I-15
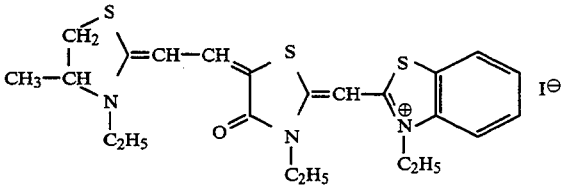
I-16
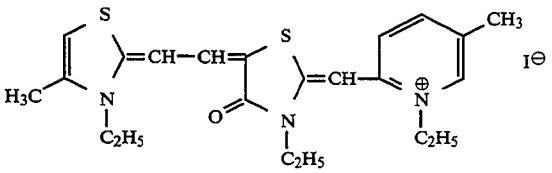
I-17
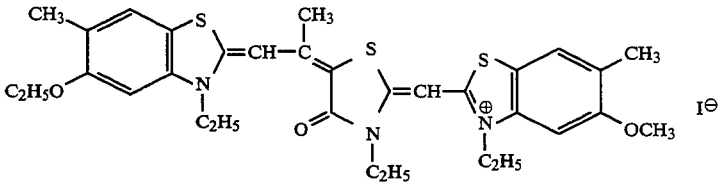
I-18
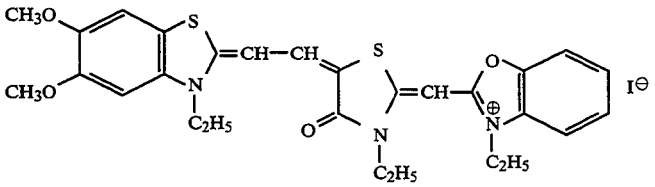

-continued
I-19
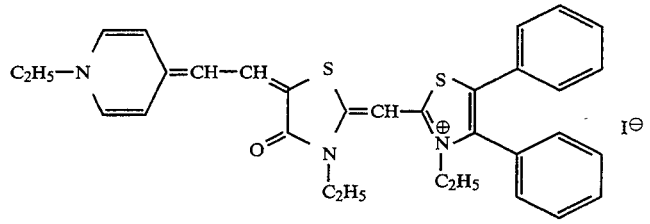
I-20
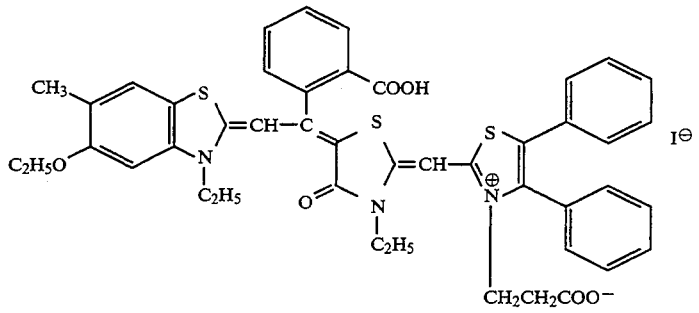
I-21
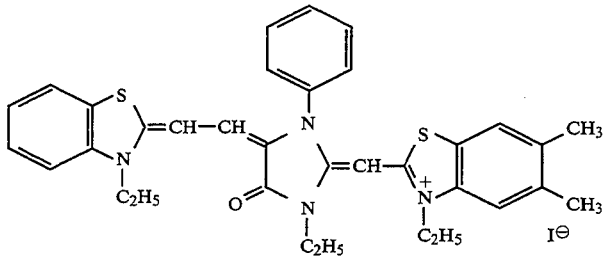
I-22
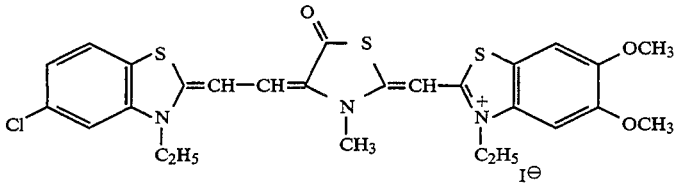
I-23
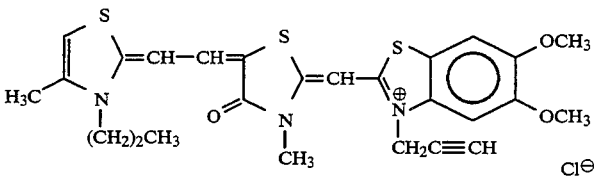
I-24
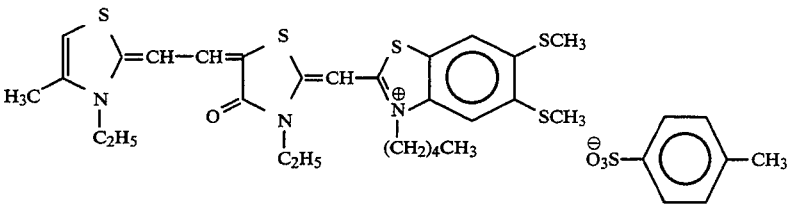

-continued
I-25
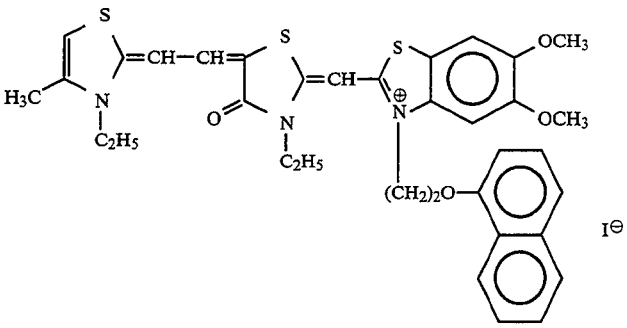
I-26
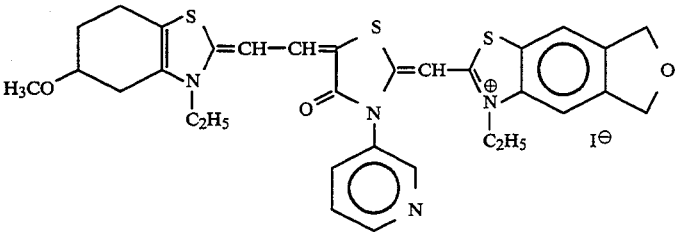
I-27
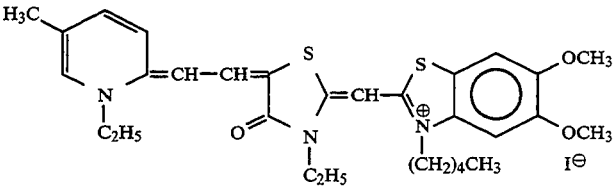
I-28
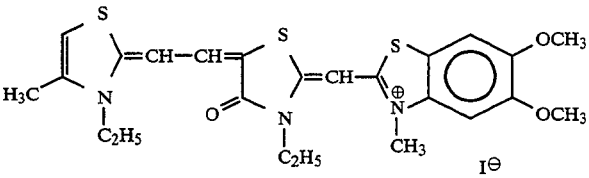
I-29
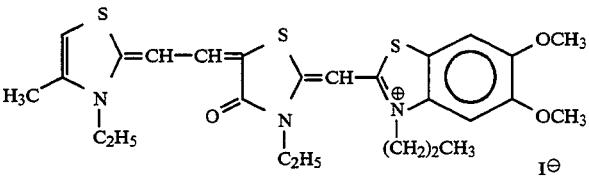
I-30
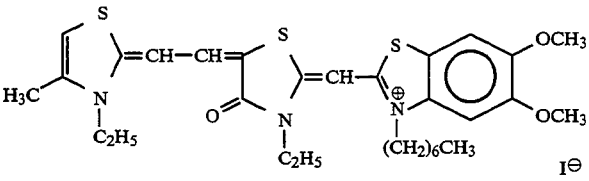
I-31
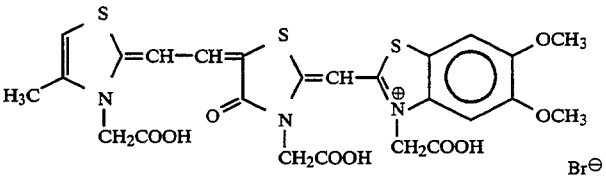

-continued

I-32

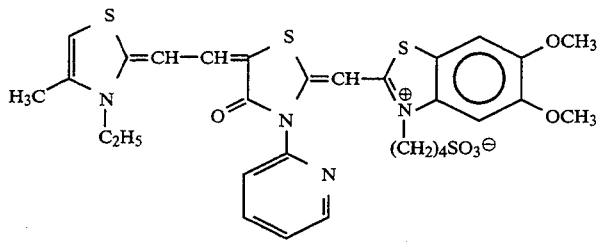

I-33

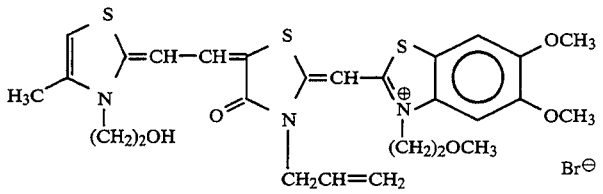

I-34

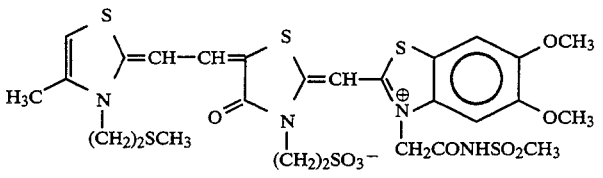

I-35

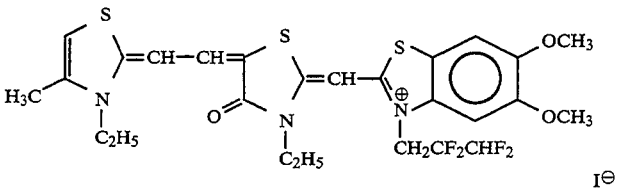

These sensitizing dyes may be employed individually or in combination. Combinations of sensitizing dyes are often used for the purpose of supersensitization. Materials which can exhibit a supersensitizing effect in combination with a certain sensitizing dye although they themselves do not spectrally sensitize silver halide emulsions or do not absorb light in the visible region may be incorporated into the silver halide emulsions.

Useful sensitizing dyes, supersensitizing combinations of dyes and materials exhibiting a supersensitizing effect are described, e.g., in *Research Disclosure*, vol. 176, No. 17643, item IV-J at 23 page (Dec. 1978), or the above-cited patent specifications such as JP-B-49-25500, JP-B-43-4933, JP-A-59-19032, JP-A-59-192242 and so on.

It is desirable that the optimum content of sensitizing dyes be chosen depending on the grain size and the halide composition of the silver halide emulsion to be sensitized, the method and the degree of chemical sensitization, the relation between the layer to contain said sensitizing dye and the silver halide emulsion layer, the kind of an antifogging compound used together with the sensitizing dye, and so on. The determination of the optimum amount can be made by methods well-known in the art. Usually, the sensitizing dyes are used in an amount of preferably $10^{-7}$ to $1\times10^{-2}$ mole, particularly $10^{-6}$ to $5\times10^{-3}$ mole, per mole of silver halide.

The present invention does not have any particular restriction as to various kinds of additives used in the photosensitive material. For instance, the additives described in the passages of the references cited below can be preferably used.

| Items | References (corresponding passages) |
|---|---|
| 1) Silver halide emulsions and their preparation methods | JP-A-2-97939 (from 12th line in right lower column at page 20 to 14th line in left lower column at page 21) JP-A-2-12236 (from 19th line in right upper column at page 7 to 12th line in left lower column at page 8) Silver halide solvents disclosed in JP-A-4-324855 |
| 2) Sensitizing dyes usable together with the sensitizing dyes of the present invention for spectral sensitization | JP-A-2-55349 (from 8th line in left upper column at page 7 to 8th line in right lower column at page 8) JP-A-2-39042 (from 8th line in right lower column at page 7 to 5th line in right lower column at page 13 |
| 3) Antifoggants Stabilizers | JP-A-2-103536 (from 19th line in right lower column at page 17 to 4th line in right upper column at page 18 and from 1st to 5th line in right lower column at page 18) In particular, polyhydroxybenzenes as disclosed in JP-A-2-55349, from 9th line in left upper column to 17th line in right lower column at page 11, are added to advantage. |
| 4) Dyes | JP-A-2-103536 (from 1st line to 18th line in right lower column at page 17) JP-A-2-39042 (from 1st line in right upper column at page 4 to 5th line in right upper column at page 6) |
| 5) Hydrazine nucleation agents and accelerators | JP-A-2-12236 (from 19th line in right upper column at page 2 to 3rd line in right upper column at page 7) |

-continued

| Items | References (corresponding passages) |
|---|---|
| | JP-A-2-103536 (from 13th line in right upper column at page 9 to 10th line in left upper column at page 16) |
| 6) Surfactants Antistatic agents | JP-A-2-12236 (from 7th line in right upper column to 7th line in right lower column at page 9) JP-A-2-18542 (from 13th line in left lower column at page 2 to 18th line in right lower column at page 4) |
| 7) Compounds having acidic groups | JP-A-2-103536 (from 6th line in right lower column at page 18 to 1st line in left upper column at page 19) JP-A-3-55349 (from 13th line in right lower column at page 8 to 8th line in left upper column at page 11) |
| 8) Hardeners | JP-A-2-103536 (from 5th line to 17th line in right upper column at page 18) |
| 9) Matting agents, Lubricants, Plasticizers | JP-A-2-103536 (from 15th line in left upper column to 15th line in right upper column at page 19) |
| 10) Polymer latexes | JP-A-2-103536 (from 12th line to 20th line in left lower column at page 18) |
| 11) Binders | JP-A-2-103536 (from 1st line to 20th line in right lower column at page 3) |
| 12) Developers and Fixers | JP-A-2 103536 (from 16th line in right upper column at page 19 to 8th line in left upper column at page 21) |

The invention will now be illustrated in further detail by the following examples, which, however, are not intended to limit the invention in any way.

EXAMPLE 1

To the Solution 1 set forth in Table 1 below, which was maintained at 38° C. and pH 4.5, the Solutions 2-a and 2-b set forth in Table 1 were simultaneously added over a 16-minute period with stirring, thereby forming the grain cores. Thereto, the Solutions 3-a and 3-b set forth in Table 1 were further added over a 16-minute period, thereby forming the grain shells. Furthermore, 0.15 g of potassium iodide was admixed therewith to complete the grain formation.

As for the metal to be contained in the Solution 2-b, the metal compounds set forth in Table 7 below were used by turns in the respective amounts set forth in Table 7. As a result thereof, five (5) kinds of solutions were prepared as the Solution 2-b.

Each of the thus obtained emulsions was washed with water in a conventional manner, specifically using a flocculation method, and then 30 g of gelatin was added thereto. Each of the resulting emulsions was adjusted to pH 5.6 and pAg 7.5, and divided into three equal parts. One part was subjected to gold-sulfur sensitization with sodium thiosulfate and chloroauric acid. Another part was subjected to gold-sulfur-selenium sensitization with sodium thiosulfate, chloroauric acid and Compound S-10 illustrated hereinbefore. Still another part was subjected to gold-sulfur-tellurium sensitization with sodium thiosulfate, chloroauric and Compound T-15 illustrated hereinbefore. These chemical sensitization treatments were all carried out at 60° C. so as to achieve the maximum sensitivity.

To every part were further added 4-hydroxy-6-methyl-1,3,3a,7-tetraazaindene as a stabilizer in an amount of 20 mg and phenoxyethanol as an antiseptic in an amount equivalent to 100 ppm. Thus, fifteen (15) different silver iodochlorobromide cubic grain emulsions (variation coefficient: 9%) having a chloride content of 80 mole % and an average grain size of 0.20 μm, which are shown in Table 7, were obtained.

TABLE 1

| Compositions of Solutions used | |
|---|---|
| Solution 1: | |
| Water | 1 l |
| Gelatin | 20 g |
| Sodium Chloride | 2 g |
| 1,3-Dimethylimidazolidinone-2-thione | 20 mg |
| Sodium Benzenethiosulfonate | 6 mg |
| Solution 2-a: | |
| Water | 300 ml |
| Silver Nitrate | 100 g |
| Solution 2-b: | |
| Water | 300 ml |
| Sodium Chloride | 30 g |
| Potassium Bromide | 14 g |
| Potassium Hexachloroiridate(III) | 15 ml |
| Compound shown in Table 7 | amount shown in Table 7 |
| Solution 3-a: | |
| Water | 300 ml |
| Silver Nitrate | 100 g |
| Solution 3-b: | |
| Water | 300 ml |
| Sodium Chloride | 30 g |
| Potassium Bromide | 14 g |

To each of the thus obtained emulsions, there were added 150 mg/mole Ag of Sensitizing Dye I-5 illustrated hereinbefore, 75 mg/mole Ag of disodium 4,4'-bis(4,6-naphthoxy-pyrimidin-2-ylamino)stilbenedisulfonate as a supersensitizer, 25 mg/mole Ag of 1-phenyl-5-mercaptotetrazole as a stabilizer and 6 g/mole Ag of hydroquinone.

Further, polyethylacrylate latex and 0.01 μm colloidal silica were each added in a proportion of 30 weight % with respect to the gelatin binder, and 2-bis(vinylsulfonylacetamide)-ethane was added at a coverage of 70 mg/m$^2$. Then, the resulting emulsions were coated on separate polyester supports so as to have a silver coverage of 3.2 g/m$^2$ and a gelatin coverage of 1.4 g/m$^2$. In coating each emulsion, the upper and the lower protective layers having the individual compositions shown in Table 2 below were coated simultaneously. Additionally, every support used had on the back side a BC layer and a BC protective layer having the individual compositions shown in Table 3 below.

TABLE 2

| Constitutions of Protective Layers | |
|---|---|
| Ingredient | per m$^2$ |
| Lower Protective Layer: | |
| Gelatin | 0.25 g |
| Dye (a) illustrated below | 250 mg |
| 1,5-Dihydroxy-2-benzaldoxime | 25 mg |
| 5-Chloro-8-hydroxyquinoline | 5 mg |
| Polyethylacrylate latex | 160 mg |
| Sodium benzenethiosulfonate | 5 mg |
| α-Lipoic acid | 5 mg |
| Compound (b) illustrated below | 5 mg |
| Compound (c) illustrated below | 100 mg |
| Polyacrylamide (average molecular weight 5,000) | 500 mg |
| Upper Protective Layer: | |
| Gelatin | 0.25 g |
| Silica matting agent (average grain size: 2.5 μm) | 30 mg |
| Silicone oil | 100 mg |
| Colloidal silica (grain diameter: 10 μm) | 30 mg |
| Compound (d) illustrated below | 5 mg |

TABLE 2-continued

| Constitutions of Protective Layers | |
|---|---|
| Ingredient | per $m^2$ |
| Sodium dodecylbenzenesulfonate | 22 mg |

(a)

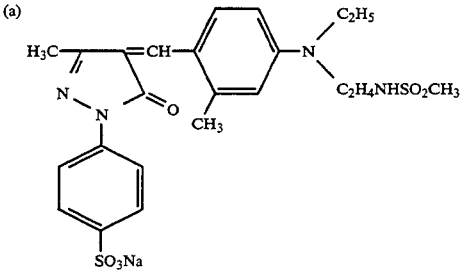

(b)

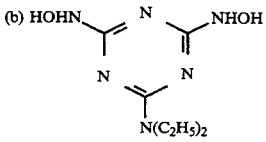

(c)

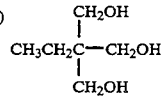

(d)

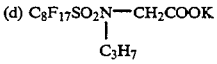

TABLE 3

| Constitutions of Backing Layers | |
|---|---|
| Ingredient | per $m^2$ |
| BC Layer: | |
| Gelatin | 0.25 mg |
| Sodium dodecylbenzenesulfonate | 20 mg |
| $SnO_2/SbO_2$ (9/1 by weight) | 300 mg |
| (average grain size: 0.25 μm) | |
| BC Protective Layer: | |
| Gelatin | 2.8 g |
| Polymethylmethacrylate | 50 mg |
| (average particle size: 3.5 μm) | |
| Dye (e) illustrated below | 35 mg |
| Dye (f) illustrated below | 35 mg |
| Dye (g) illustrated below | 120 mg |
| Sodium dodecylbenzenesulfonate | 90 mg |
| Compound (d) illustrated above | 10 mg |

TABLE 3-continued

| Constitutions of Backing Layers | |
|---|---|
| Ingredient | per $m^2$ |
| 2-Bis(vinylsulfonylacetamido)ethane | 160 mg |

(e)

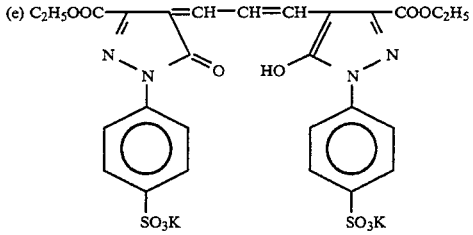

(f)

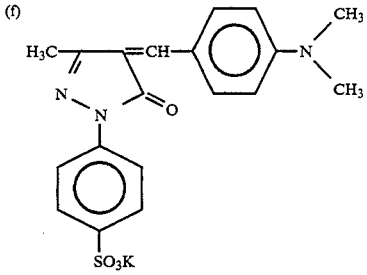

(g)

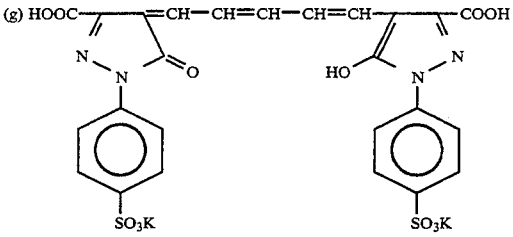

Evaluation of Photographic Properties

The thus prepared samples each were subjected to sensitometry by being exposed with a Xenon flash light having an emission time of $10^{-5}$ second via an interference filter having its peak at 633 nm and a continuous wedge, and then being photographically processed with an automatic developing machine, Automatic Processor FG-710S, made by Fuji Photo Film Co., Ltd., operated under the conditions described in Table 4 below. Each sample was examined for the amount of exposure required to for provide a density of 3.0, and the reciprocal of said amount was taken as the sensitivity thereof. The sensitivities so determined are shown as relative values. In addition, the slope of the line connecting the points at which the densities were 0.1 and 3.0 respectively was defined as the gradient.

TABLE 4

| Processing Condition adopted in FG 710S | | |
|---|---|---|
| Steps | Temperature | Time |
| Insertion | | 2 seconds |
| Development | 38° C. | 16 seconds |
| Fixation | 37° C. | 16 seconds |
| Washing | 26° C. | 9 seconds |
| Squeeze | | 3 seconds |
| Drying | 55° C. | 15 seconds |
| | Total processing time: | 61 seconds |

The developer and the fixer used herein had the compositions described in Table 5 and Table 6 below, respectively.

TABLE 5

| Composition of Developer | |
|---|---|
| Sodium 1,2-dihydroxybenzene-3,5-disulfonate | 0.5 g |
| Diethylenetriaminetetraacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3 pyrazolidone | 1.6 g |
| 2,3,5,6,7,8-hexahydro-2-thioxo-4-(1H)-quinazoline | 0.05 g |
| Sodium 2-mercaptobenzimidazole-5-sulfonate | 0.3 g |
| Water to make | 1 l |
| Potassium hydroxide to adjust | pH 10.7 |

TABLE 6

| Composition of Fixer | |
|---|---|
| Sodium thiosulfate (anhydrous) | 150 g |
| Compound-h shown below | 0.1 mole |
| Sodium hydrogen sulfite | 30 g |
| Disodium ethylenediaminetetraacetate dihydrate | 25 g |
| Water to make | 1 l |
| Sodium hydroxide to adjust | pH 6.0 |

Compound-h:

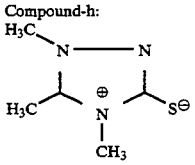

The results obtained are shown in Table 7 below.

TABLE 7

| Sample No. | Species of Compound | Amount added (mol/mol Ag) | Chemical Sensitization*1 | Sensitivity | Gradient | Fog | Note |
|---|---|---|---|---|---|---|---|
| 1 | — | — | S + Au | 100 | 5.0 | 0.05 | Comparison |
| 2 | — | — | Se + S + Au | 110 | 4.5 | 0.09 | Comparison |
| 3 | — | — | Te + S + Au | 105 | 4.4 | 0.12 | Comparison |
| 4 | $NH_3RhCl_6$ | $1.5 \times 10^{-7}$ | S + Au | 60 | 7.0 | 0.05 | Comparison |
| 5 | $NH_3RhCl_6$ | $1.5 \times 10^{-7}$ | Se + S + Au | 88 | 7.8 | 0.05 | Invention |
| 6 | $NH_3RhCl_6$ | $1.5 \times 10^{-7}$ | Te + S + Au | 85 | 7.6 | 0.05 | Invention |
| 7 | $K_3ReCl_6$ | $4 \times 10^{-7}$ | S + Au | 61 | 6.8 | 0.05 | Comparison |
| 8 | $K_3ReCl_6$ | $4 \times 10^{-7}$ | Se + S + Au | 88 | 7.9 | 0.05 | Invention |
| 9 | $K_3ReCl_6$ | $4 \times 10^{-7}$ | Te + S + Au | 85 | 7.3 | 0.05 | Invention |
| 10 | $K_2RuCl_5(NO)$ | $2 \times 10^{-7}$ | S + Au | 58 | 7.0 | 0.05 | Comparison |
| 11 | $K_2RuCl_5(NO)$ | $2 \times 10^{-7}$ | Se + S + Au | 85 | 7.9 | 0.05 | Invention |
| 12 | $K_2RuCl_5(NO)$ | $2 \times 10^{-7}$ | Te + S + Au | 83 | 7.7 | 0.05 | Invention |
| 13 | $K_3Fe(CN)_6$ | $2 \times 10^{-6}$ | S + Au | 100 | 4.6 | 0.05 | Comparison |
| 14 | $K_3Fe(CN)_6$ | $2 \times 10^{-6}$ | Se + S + Au | 105 | 4.3 | 0.05 | Comparison |
| 15 | $K_3Fe(CN)_6$ | $2 \times 10^{-6}$ | Te + S + Au | 108 | 4.2 | 0.05 | Comparison |

*1: S, Se, Te and Au represent sulfur sensitization, selenium sensitization, tellurium sensitization and gold sensitization respectively.

As can be seen from the data set forth in Table 7, the system free from any metal relating to the present invention and the system containing the salt of Fe as a metal for comparison caused a decrease of gradient and an increase of fog by the selenium or tellurium sensitization carried out in combination with sulfur-gold sensitization, while these sensitization treatments succeeded in increasing both the sensitivity and the gradient in the samples prepared in accordance with embodiments of the present invention, namely Sample Nos. 5, 6, 8, 9, 11 and 12.

EXAMPLE 2

Similarly to the samples in Example 1, there were prepared emulsions for comparison, Sample Nos. 16, 17 and 18 (which underwent different chemical sensitization treatments, S+Au, Se+S+Au and Te+S+Au, respectively). In preparing them, $1.5 \times 10^{-7}$ mole/mole Ag of $NH_3RHCl_6$ was used in the Solution 2-b as the compound shown in Table 7 and the amounts of sodium chloride and potassium bromide used in both the Solutions 2-b and 3-b were changed so that the resulting emulsions might have a chloride content of 40 mole %. These samples and certain of the samples prepared in Example 1 were each subjected to the same photographic processing as in Example 1, except that the development time was reduced to 12 seconds by increasing the linear speed of the automatic developing machine. The results obtained are shown in Table 8 below.

TABLE 8

| Sample No. | Species of Compound | Chloride Content (mole %) | Chemical Sensitization*1 | Sensitivity | Gradient | Fog | Note |
|---|---|---|---|---|---|---|---|
| 4 | $NH_3RhCl_6$ | 80 | S + Au | 50 | 6.6 | 0.05 | Comparison |
| 5 | $NH_3RhCl_6$ | 80 | Se + S + Au | 88 | 7.8 | 0.05 | Invention |
| 6 | $NH_3RhCl_6$ | 80 | Te + S + Au | 85 | 7.6 | 0.05 | Invention |
| 7 | $K_3ReCl_6$ | 80 | S + Au | 51 | 6.0 | 0.05 | Comparison |
| 8 | $K_3ReCl_6$ | 80 | Se + S + Au | 87 | 8.0 | 0.05 | Invention |
| 9 | $K_3ReCl_6$ | 80 | Te + S + Au | 84 | 7.4 | 0.05 | Invention |
| 10 | $K_2RuCl_5(NO)$ | 80 | S + Au | 48 | 6.3 | 0.05 | Comparison |
| 11 | $K_2RuCl_5(NO)$ | 80 | Se + S + Au | 85 | 7.9 | 0.05 | Invention |
| 12 | $K_2RuCl_5(NO)$ | 80 | Te + S + Au | 84 | 7.8 | 0.05 | Invention |
| 13 | $K_3Fe(CN)_6$ | 80 | S + Au | 80 | 4.0 | 0.05 | Comparison |
| 14 | $K_3Fe(CN)_6$ | 80 | Se + S + Au | 85 | 3.8 | 0.10 | Comparison |
| 15 | $K_3Fe(CN)_6$ | 80 | Te + S + Au | 88 | 3.6 | 0.15 | Comparison |
| 16 | $NH_3RhCl_6$ | 40 | S + Au | 80 | 6.0 | 0.05 | Comparison |

TABLE 8-continued

| Sample No. | Species of Compound | Chloride Content (mole %) | Chemical Sensitization*1 | Sensitivity | Gradient | Fog | Note |
|---|---|---|---|---|---|---|---|
| 17 | $NH_3RhCl_6$ | 40 | Se + S + Au | 78 | 6.8 | 0.05 | Comparison |
| 18 | $NH_3RhCl_6$ | 40 | Te + S + Au | 75 | 6.6 | 0.05 | Comparison |

*1: S, Se, Te and Au represent sulfur sensitization, selenium sensitization, tellurium sensitization and gold sensitization respectively.

As can be seen from Table 8, both high sensitivity and high contrast were achieved by the present samples even in case of rapid processing.

EXAMPLE 3

Films having 3.6 g/m$^2$, based on silver, of a coating of a silver chlorobromide emulsion having a chloride content of 70 mole % were subjected to continuous processing with an automatic developing machine, FG-710S, the same as used for the evaluation of sensitivity in the foregoing examples, under a condition such that the sample films, some of which were exposed to light and others of which were unexposed, were processed at a replenishment rate of 180 ml/m$^2$ in each mother solutions for development and fixation. A ratio of the exposed and the unexposed sample films processed, were 1:1. The processing was continued until the total area of the both processed films was brought up to 150 m$^2$. The thus obtained processing solutions were used in evaluating the sensitivity at 633 nm and the gradient, and the evaluation result of these properties was expressed in terms of the difference between the results obtained using the fresh processing solutions and those obtained using the continuously used ones. Further, the clarity upon fixation was also evaluated.

The samples used for the evaluation were the same as used in Example 2. The results obtained are shown in Table 9 below.

TABLE 9

| Sample No. | Species of Compound | Chloride Content (mole %) | Chemical Sensitization*1 | 12 seconds' Development: Change for Sensitivity | 12 seconds' Development: Change for Gradient | 12 seconds' Development: Clarity Upon Fixation | 16 seconds' Development: Change for Sensitivity | 16 seconds' Development: Change for Gradient | 16 seconds' Development: Clarity Upon Fixation |
|---|---|---|---|---|---|---|---|---|---|
| 4 | $NH_3RhCl_6$ | 80 | S + Au | −35 | −1.0 | good | −10 | −0.6 | good |
| 5 | $NH_3RhCl_6$ | 80 | Se + S + Au | −2 | −0.1 | good | 0 | 0 | good |
| 6 | $NH_3RhCl_6$ | 80 | Te + S + Au | 0 | 0 | good | 0 | 0 | good |
| 7 | $K_3ReCl_6$ | 80 | S + Au | −35 | −1.0 | good | −10 | −0.6 | good |
| 8 | $K_3ReCl_6$ | 80 | Se + S + Au | −3 | −0.1 | good | 0 | 0 | good |
| 9 | $K_3ReCl_6$ | 80 | Te + S + Au | −4 | 0 | good | 0 | 0 | good |
| 10 | $K_2RuCl_5(NO)$ | 80 | S + Au | −38 | −1.0 | good | −10 | −0.6 | good |
| 11 | $K_2RuCl_5(NO)$ | 80 | Se + S + Au | −2 | −0.1 | good | 0 | 0 | good |
| 12 | $K_2RuCl_5(NO)$ | 80 | Te + S + Au | −3 | −0.2 | good | 0 | 0 | good |
| 13 | $K_3Fe(CN)_6$ | 80 | S + Au | −48 | −1.0 | good | −10 | −0.6 | good |
| 14 | $K_3Fe(CN)_6$ | 80 | Se + S + Au | −40 | −0.7 | good | −8 | −0.4 | good |
| 15 | $K_3Fe(CN)_6$ | 80 | Te + S + Au | −38 | −0.8 | good | −9 | −0.6 | good |
| 16 | $NH_3RhCl_6$ | 40 | S + Au | −48 | −1.0 | no good | −10 | −0.6 | good |
| 17 | $NH_3RhCl_6$ | 40 | Se + S + Au | −28 | −0.8 | no good | −10 | −0.5 | good |
| 18 | $NH_3RhCl_6$ | 40 | Te + S + Au | −30 | −0.7 | no good | −15 | −0.4 | good |

*1: S, Se, Te and Au represent sulfur sensitization, selenium sensitization, tellurium sensitization and gold sensitization respectively.

As can be seen from Table 9, the samples of the present invention achieved consistent results in terms of the their photographic properties and had good fixability in both general and rapid processing operations even when these operations were performed continuously.

EXAMPLE 4

Samples were prepared in the same manner as Sample No. 5 prepared in Example 1, except that the Sensitizing Dye I-5 was replaced by those shown in Table 10 respectively. The photographic properties of the samples were evaluated under the same conditions as in Example 2.

Further, these samples were examined for color stain, and the evaluation thereof was made in terms of five relative grades, with 5 being the best and 1 being the worst.

The results obtained are shown in Table 10 below.

TABLE 10

| Sample No. | Sensitizing Dye | Sensitivity | Gradient | Fog | Color stain | Note |
|---|---|---|---|---|---|---|
| 5 | I-5 | 88 | 7.6 | 0.05 | 5 | Invention |
| 19 | I-8 | 90 | 7.6 | 0.05 | 5 | Invention |
| 20 | I-7 | 92 | 7.7 | 0.05 | 5 | Invention |
| 21 | I-13 | 85 | 7.6 | 0.05 | 5 | Invention |
| 22 | (h) | 60 | 7.4 | 0.07 | 2 | Comparison |
| 23 | (I) | 80 | 7.6 | 0.08 | 1 | Comparison |
| 24 | (J) | 58 | 7.5 | 0.07 | 2 | Comparison |

(h)

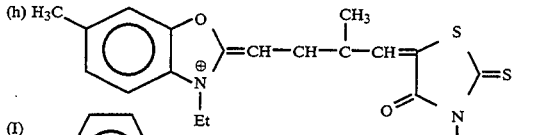

(I)

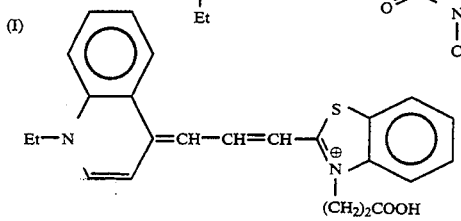

(J)

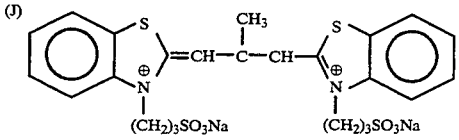

The results in Table 10 show that the sensitizing dyes of the present invention proved to be superior in color stain to the dyes used for comparison.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which has on a support at least one layer of a light-sensitive silver halide emulsion comprising silver halide grains having a chloride content of at least 50 mole % and containing a metal selected from rhodium, ruthenium and rhenium in an amount of at least $10^{-8}$ mole per mole of silver, said silver halide emulsion being spectrally sensitized with a compound having a structure represented by the following general formula (I) and being chemically sensitized with a selenium or tellurium compound:

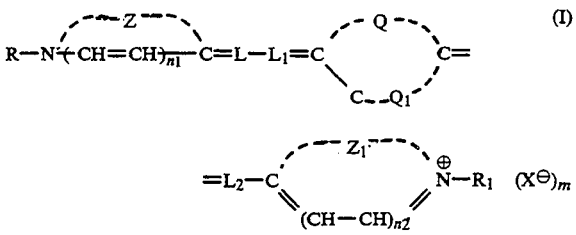

(I)

wherein Z and $Z_1$ each represents a group of nonmetallic atoms necessary to complete a 5- or 6-membered nitrogen-containing heterocyclic nucleus; R and $R_1$ each represents an unsubstituted or substituted alkyl group, or an unsubstituted aryl group; Q and $Q_1$ each represents a group of atoms necessary to complete a 4-thiazolidinone, 5-thiazolidinone or 4-imidazolidinone nucleus; L, $L_1$ and $L_2$ each represents an unsubstituted or substituted methine group; $n_1$ and $n_2$ each represents 0 or 1; X represents an anion; and m represents 0 or 1, wherein m=0 indicates that the dye forms an inner salt.

2. The silver halide photographic material of claim 1, wherein the silver halide grains in the silver halide emulsion have a chloride content of at least 70 mole %.

3. The silver halide photographic material of claim 1, wherein the silver halide grains in the silver halide emulsion are fine grains having an average grain size no greater than 0.7 microns.

4. The silver halide photographic material of claim 1, wherein the silver halide grains in the silver halide emulsion are fine grains having an average grain size no greater than 0.5 microns.

5. The silver halide photographic material of claim 1, wherein the silver halide grains in the silver halide emulsion are cubic, tetradecahedral, or tabular grains.

6. The silver halide photographic material of claim 1, wherein the silver halide emulsion is a monodisperse emulsion.

7. The silver halide photographic material of claim 1, wherein the metal selected from rhodium, ruthenium and rhenium is incorporated in the silver halide grains in the form of a water soluble complex salt of the metal.

8. The silver halide photographic material of claim 7, wherein the total amount of the water soluble complex salt of the metal is from $5\times10^{-9}$ to $1\times10^{-4}$ mol per mole of silver halide in the emulsion.

9. The silver halide photographic material of claim 7, wherein the total amount of the water soluble complex salt of the metal is from $1\times10^{-8}$ to $1\times10^{-6}$ mol per mole of silver halide in the emulsion.

10. The silver halide photographic material of claim 7, wherein the total amount of the water soluble complex salt of the metal is from $5\times10^{-8}$ to $1\times10^{-7}$ mol per mole of silver halide in the emulsion.

11. The silver halide photographic material of claim 1, wherein the amount of the selenium or tellurium compound is from $10^{-8}$ to $10^{-2}$ mole per mole of silver halide in the emulsion.

12. The silver halide photographic material of claim 1, wherein the amount of the selenium or tellurium compound is from $10^{-7}$ to $10^{-3}$ mole per mole of silver halide in the emulsion.

13. The silver halide photographic material of claim 1, wherein the silver halide emulsion is further sensitized with a precious metal sensitizer.

14. The silver halide photographic material of claim 13, wherein the silver halide emulsion is further sensitized with a sulfur sensitizer.

15. A method of processing a silver halide photographic material which comprises image-wise exposing said photographic material and processing said photographic material with an automatic developing machine wherein the replenishment rates of a developer and a fixer are each controlled to at most 200 ml/m$^2$, wherein said photographic material comprises on a support at least one layer of a light-sensitive silver halide emulsion comprising silver halide grains having a chloride content of at least 50 mole % and containing a metal selected from rhodium, ruthenium and rhenium in an amount of at least $10^{-8}$ mole per mole of silver, said silver halide emulsion being spectrally sensitized with a compound having a structure represented by the following general formula (I) and being chemically sensitized with a selenium or tellurium compound:

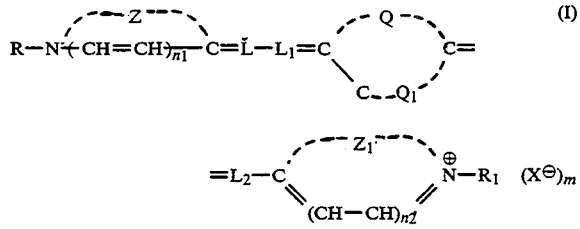

(I)

wherein Z and $Z_1$ each represents a group of nonmetallic atoms necessary to complete a 5- or 6-membered nitrogen-containing heterocyclic nucleus; R and $R_1$ each represents an unsubstituted or substituted alkyl group, or an unsubstituted aryl group; Q and $Q_1$ each represents a group of atoms necessary to complete a 4-thiazolidinone, 5-thiazolidinone or 4-imidazolidinone nucleus; L, $L_1$ and $L_2$ each represents an unsubstituted or substituted methine group; $n_1$ and $n_2$ each represents 0 or 1; X represents and anion, m represents 0 or 1, wherein m=0 indicates that the dye forms an inner salt.

16. A method of processing a silver halide photographic material which comprises image-wise exposing said photographic material and processing said photographic material with an automatic developing machine wherein the total processing time is adjusted so as to be within the range of 15 to 60 seconds, wherein said photographic material comprises on a support at least one layer of a light-sensitive silver halide emulsion comprising silver halide grains having a chloride content of at least 50 mole % and containing a metal selected from rhodium, ruthenium and rhenium in an amount of at least $10^{-8}$ mole per mole of silver, said silver halide emulsion being spectrally sensitized with a compound having a structure represented by the following general formula (I) and being chemically sensitized with a selenium or tellurium compound:

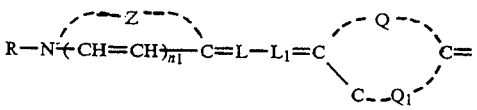

(I)

-continued

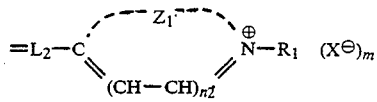

wherein Z and $Z_1$ each represents a group of nonmetallic atoms necessary to complete a 5- or 6-membered nitrogen-containing heterocyclic nucleus; R and $R_1$ each represents an unsubstituted or substituted alkyl group, or an unsubstituted aryl group; Q and $Q_1$ each represents a group of atoms necessary to complete a 4-thiazolidinone, 5-thiazolidinone or 4-imidazolidinone nucleus; L, $L_1$ and $L_2$ each represents an unsubstituted or substituted methine group; $n_1$ and n2 each represents 0 or 1; X represents an anion; m represents 0 or 1, wherein m=0 indicates that the dye forms an inner salt.

* * * * *